US007712461B1

(12) United States Patent
Souffrant

(10) Patent No.: US 7,712,461 B1
(45) Date of Patent: May 11, 2010

(54) AIR PROPELLING TOY

(76) Inventor: Jackson J. Souffrant, 240-02 141 Ave., Rosedale, NY (US) 11422

( * ) Notice: Subject to any disclaimer, the term of this patent is extended or adjusted under 35 U.S.C. 154(b) by 38 days.

(21) Appl. No.: 12/015,211

(22) Filed: Jan. 16, 2008

(51) Int. Cl.
*F41B 9/00* (2006.01)

(52) U.S. Cl. ..... 124/55; 124/56; 42/54

(58) Field of Classification Search ..... 124/55, 124/56; 42/54
See application file for complete search history.

(56) References Cited

U.S. PATENT DOCUMENTS 2,614,551 A 10/1952 Shelton
2,846,996 A * 8/1958 Drynan ..... 124/55
2,879,759 A 3/1959 Webb
4,157,703 A 6/1979 Brown et al.
5,141,236 A 8/1992 Petitto
2004/0226548 A1 11/2004 Jordan et al.

* cited by examiner

*Primary Examiner*—Stephen M Johnson
*Assistant Examiner*—Daniel J Troy

(57) ABSTRACT

An air propelling toy for directing a quantity of air in a desired direction includes a housing including a perimeter wall that defines an interior space of the housing. The housing has an outlet port that extends through the perimeter wall and is in fluid communication with the interior space. A diaphragm is coupled to the housing and positioned in the interior space of the housing and divides the interior space into an air space and a mechanism space. The air space is in fluid communication with the outlet port. An actuating assembly is operationally coupled to the housing and the diaphragm. The actuating assembly is actuated to draw the diaphragm into the mechanism space to draw air into the sir space through the outlet port and quickly release the diaphragm to force the air out of the air space and out the outlet port.

7 Claims, 4 Drawing Sheets

AIR PROPELLING TOY

BACKGROUND OF THE INVENTION

1. Field of the Invention

The present invention relates to toy guns and more particularly pertains to a new toy gun for directing a quantity of air in a desired direction.

2. Description of the Prior Art

The use of toy guns is known in the prior art. While these devices fulfill their respective, particular objectives and requirements, the need remains for a device that has certain improved features that allow a trigger of the device to be pulled multiple times in succession to allow multiples quantities of air to be ejected by the device. Additionally, the device should include an actuating assembly that is fully actuated by the pulling of the trigger and does not need to be cocked between each pull of the trigger.

SUMMARY OF THE INVENTION

The present invention meets the needs presented above by generally comprising a housing being graspable by a person. The housing includes a perimeter wall that defines an interior space of the housing. The housing has an outlet port that extends through the perimeter wall and is in fluid communication with the interior space. The outlet port is positioned adjacent a adjacent a front end of the housing. A diaphragm is coupled to the housing and positioned in the interior space of the housing. The diaphragm divides the interior space into an air space and a mechanism space. The air space is in fluid communication with the outlet port. An actuating assembly is operationally coupled to the housing and the diaphragm. The actuating assembly is actuated to draw the diaphragm into the mechanism space to draw air into the sir space through the outlet port and quickly release the diaphragm to force the air out of the air space and out the outlet port.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
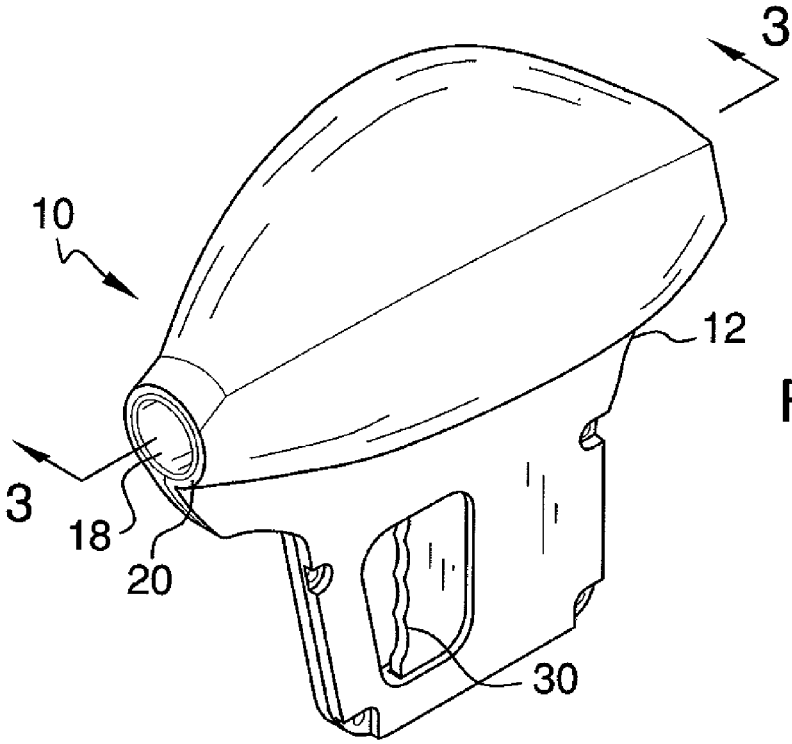
FIG. 1 is a perspective view of an air propelling toy according to the present invention.
Figure 2:
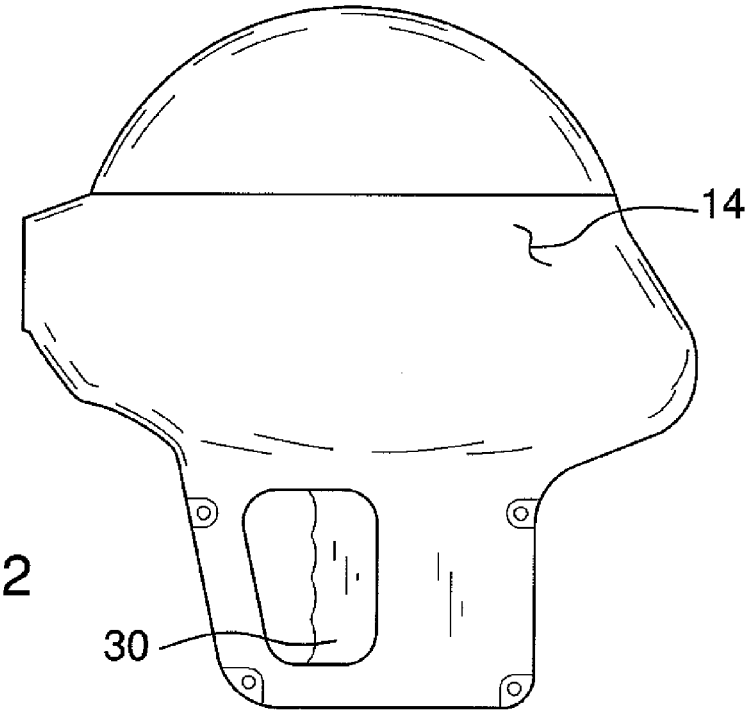
FIG. 2 is a side view of the present invention.
Figure 3:
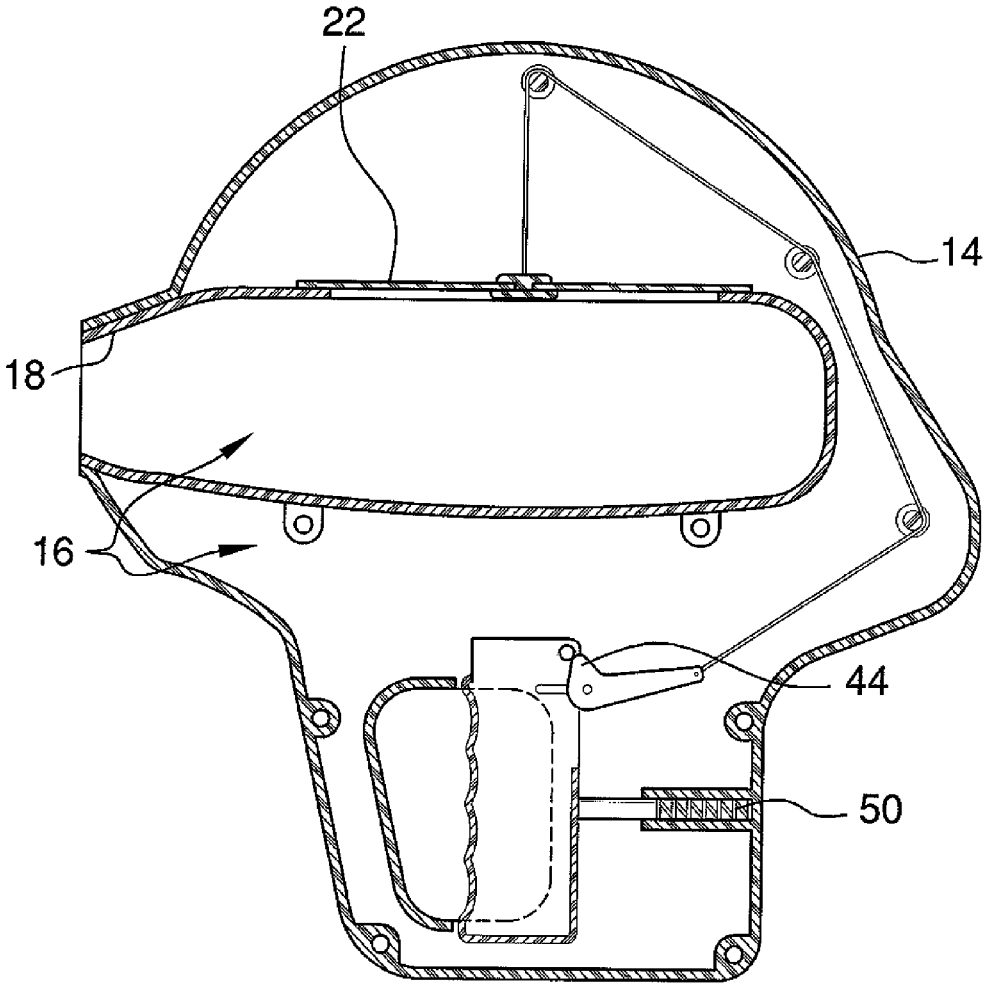
FIG. 3 is a cross-sectional view of the present invention taken along line 3-3 of FIG. 1.
Figure 4:
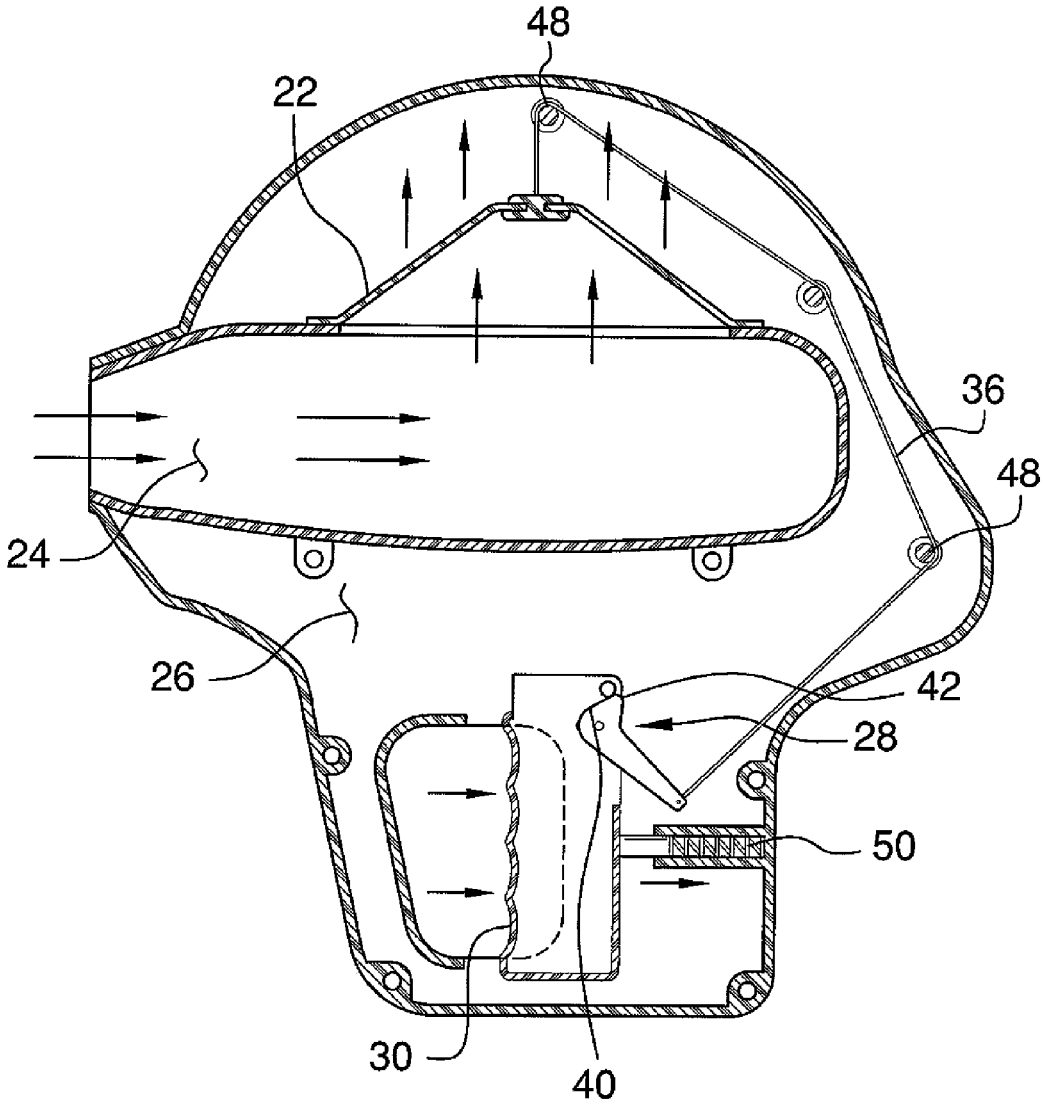
FIG. 4 is the cross-sectional view of the present invention shown in FIG. 3 as a trigger is being slid from a forward position to a retracted position.
Figure 5:
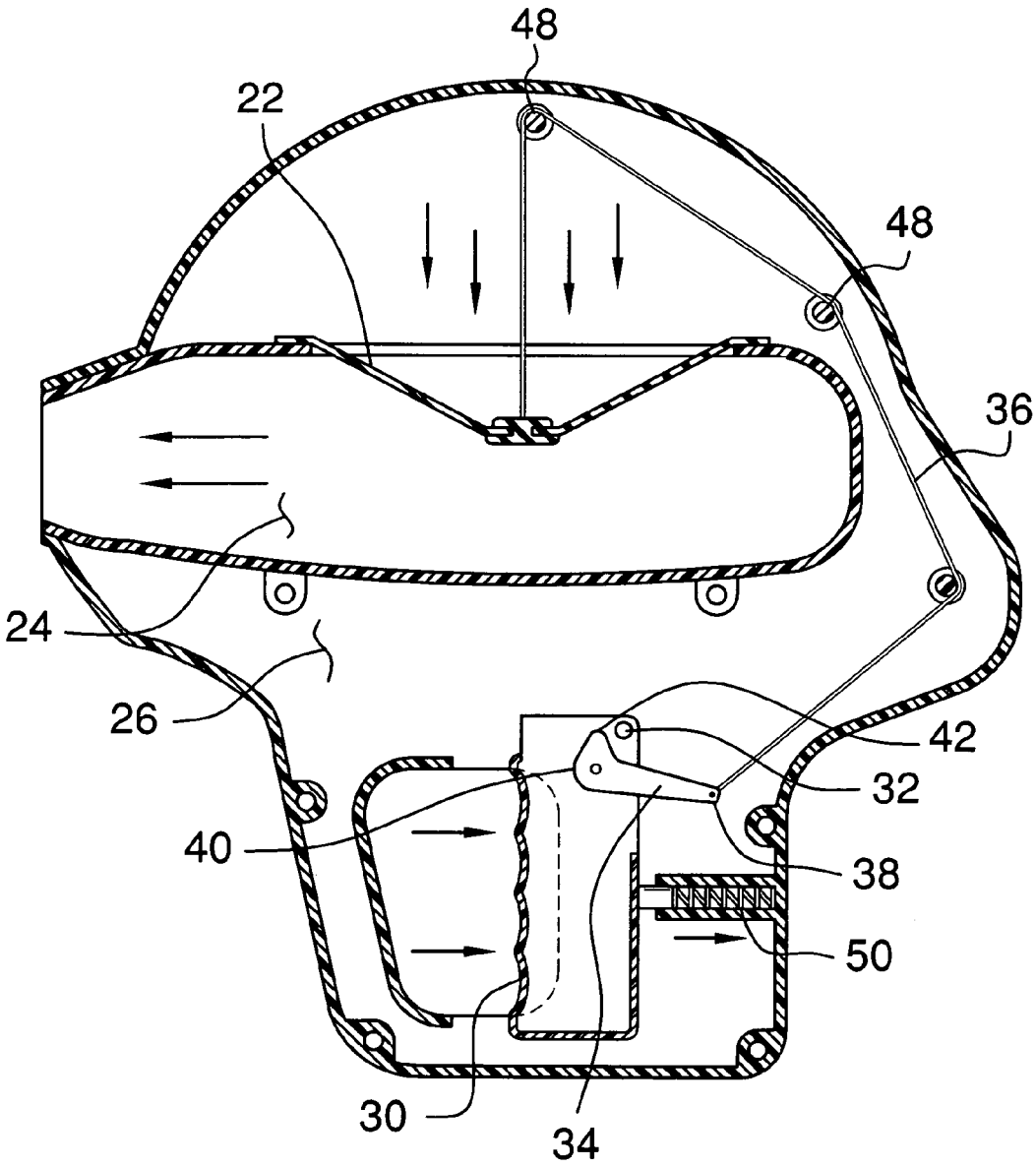
FIG. 5 is the cross-sectional view of the present invention shown in FIG. 3 as the trigger reaches a retracted position.

With reference now to the drawings, and in particular to FIGS. 1 through 5 thereof, a new toy gun embodying the principles and concepts of the present invention and generally designated by the reference numeral 10 will be described.

As best illustrated in FIGS. 1 through 5, the air propelling toy 10 generally comprises a housing 12 being graspable by a person. The housing 12 includes a perimeter wall 14 that defines an interior space 16 of the housing 12. The housing 12 has an outlet port 18 that extends through the perimeter wall 14 and is in fluid communication with the interior space 16. The outlet port 18 is positioned adjacent a front end 20 of the housing 12. The housing 12 is approximately gun shaped. The housing 12 has a length of approximately 9 inches and width of approximately 2⅔ inches.

A diaphragm 22 is coupled to the housing 12 and positioned in the interior space 16 of the housing 12. The diaphragm 22 divides the interior space 16 into an air space 24 and a mechanism space 26. The air space 24 is in fluid communication with the outlet port 18. The diaphragm 22 is comprised a comprised a flexible material. The diaphragm 22 is positioned approximately horizontal and approximately parallel to a longitudinal axis of the air space 24. The approximate horizontal position of the diaphragm 22 inhibits solid objects placed in the air space 24 from being launched out of the outlet port 18 by the diaphragm 22.

An actuating assembly 28 is operationally coupled to the housing 12 and the diaphragm 22. The actuating assembly 28 is actuated to draw the diaphragm 22 into the mechanism space 26 to draw air into the sir space through the outlet port 18 and quickly release the diaphragm 22 to force the air out of the air space 24 and out the outlet port 18. A trigger 30 is slidably coupled to the housing 12. The trigger 30 is slid from a forward position to a retracted position to actuate the actuating assembly 28. The trigger 30 is slid into the mechanism space 26 when the trigger 30 is slid from the forward position to the retracted position.

A pivot rod 32 is coupled to the trigger 30 and is moved forward or rearward with the trigger 30. A lever 34 is pivotally coupled to the housing 12. The lever 34 is positioned adjacent to the trigger 30 and the pivot rod 32. The lever 34 is pivoted by the pivot rod 32 when the pivot rod 32 engages the lever 34 as the pivot rod 32 is moved forward or rearward with the trigger 30. A cable 36 is coupled to the lever 34 and the diaphragm 22. The cable 36 pulls the diaphragm 22 into the mechanism space 26 when the trigger 30 is being slid from the forward position to the retracted position and the pivot rod 32 pivots the lever 34. The cable 36 is positioned adjacent a rear edge 38 of the lever.

The pivot rod 32 abuts a front edge 40 of the lever adjacent to a top edge 42 of the lever 34 when the trigger 30 is in the forward position. The pivot rod 32 forces the rear edge 38 of the lever 38 to pivot downwardly to pull the cable 36 and thereby draw the diaphragm 22 into the mechanism space 26. The pivot rod 32 slides, by a raised portion 44 of the lever 34 to release the cable 36 from tension and allow the diaphragm 22 to advance into the air space 24 and force air out of the outlet port 18 when the trigger 30 is in the retracted position. The pivot rod 32 slides along a portion of the top edge 42 of the lever 34 when the trigger 30 is slid from the retracted position to the forward position. A plurality of guide pins 36 is coupled to the housing and is positioned in the mechanism space. The cable 36 is positioned on the guide pins 48 to retain the cable 36 in a taut condition.

In use, the housing 12 is gripped by the person with the fingers of the person positioned on the trigger 30. The person then directs the outlet port 18 in the desired direction. The trigger 30 is then slid from the forward position to the retracted position and the diaphragm 22 is drawn into the mechanism space 26 and then quickly released to allow the diaphragm 22 to advance into the air space 24. As the diaphragm 22 enters the air space 24 it forces a quantity of air out of the outlet port 18 in the desired direction that the outlet port 18 is pointing.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit limit the invention to the exact construction and operation shown and described, and accordingly, all suitable modifications and equivalents may be resorted to, falling within the scope of the invention.

I claim:

1. An air propelling toy for ejecting a quantity of air, said device comprising:

a housing being graspable by a person, said housing including a perimeter wall defining an interior space of said housing, said housing having an outlet port extending through said perimeter wall and being in fluid communication with said interior space, said outlet port being positioned adjacent a front end of said housing;

a diaphragm being coupled to said housing and positioned in said interior space of said housing, said diaphragm dividing said interior space into an air space and a mechanism space, said air space being in fluid communication with said outlet port, said diaphragm being orientated horizontal and parallel to a longitudinal axis of said air space, said outlet portion having a perimeter edge abutting said front end of said housing, said perimeter edge lying in a plane orientated perpendicular to said longitudinal axis of said air space;

an actuating assembly being operationally coupled to said housing and said diaphragm, said actuating assembly being actuated to draw said diaphragm into said mechanism space to draw air into said air space through said outlet port and quickly release said diaphragm to force the air out of said air space and out said outlet port, said actuating assembly comprising; a trigger being slidably coupled to said housing, said trigger being slid from a forward position to a retracted position to actuate said actuating assembly, said trigger being slid into said mechanism space when said trigger is slid from the forward position to the retracted position;

a pivot rod being coupled to said trigger, said pivot rod being moved forward or rearward with said trigger;

a lever being pivotally coupled to said housing, said lever being positioned adjacent to said trigger and said pivot rod, said lever being pivoted by said pivot rod when said pivot rod engages said lever as said pivot rod is moved forward or forward with said trigger; and a cable being coupled to said lever and said diaphragm, said cable pulling said diaphragm into said mechanism space when said trigger is being slid from the forward position to the retracted position and said pivot rod pivots said lever, said Cable being positioned adjacent a rear edge of said lever.

2. The device according to claim 1, wherein said housing is approximately gun shaped.

3. The device according to claim 1, wherein said diaphragm is comprised a flexible material.

4. The device according to claim 1, wherein said pivot rod abuts a front edge of said lever adjacent a top edge of said lever when said trigger is in the forward position, said pivot rod forcing said rear edge of said lever to pivot downwardly to pull said cable and thereby draw said diaphragm into said mechanism space, said lever sliding by said pivot rod to release said cable from tension and allow said diaphragm to advance into said air space and force air out of said outlet port when said trigger is in the retracted position, said pivot rod, sliding along a portion of said top edge of said lever when said trigger is slid from the retracted position to the forward position.

5. The device according to claim 4, wherein said actuating assembly includes a plurality of guide pins being coupled to said housing and positioned in said mechanism space, said cable being positioned on said guide pins to retain said cable in a taut condition.

6. The device according to claim 1, further comprising a biasing member being coupled to said actuating assembly to reset said actuating assembly after each actuation, said biasing member being positioned in said mechanism space and extending between said perimeter wall and said trigger, said biasing member biasing said trigger from the retracted position to the forward position when said trigger is released.

7. An air propelling toy for ejecting a quantity of air, said device comprising:

a housing being graspable by a person, said housing including a perimeter wall defining an interior space of said housing, said housing having an outlet port extending through said perimeter wall and being in fluid communication with said interior space, said outlet port being positioned adjacent a front end of said housing, said housing being approximately gun shaped;

a diaphragm being coupled to said housing and positioned in said interior space of said housing, said diaphragm dividing said interior space into an air space and a mechanism space, said air space being in fluid communication with said outlet port, said diaphragm being comprised a flexible material, said diaphragm being orientated horizontal and parallel to a longitudinal axis of said air space, said outlet portion having a perimeter edge abutting said front end of said housing, said perimeter edge lying in a plane orientated perpendicular to said longitudinal axis of said air space;

an actuating assembly being operationally coupled to said housing and said diaphragm, said actuating assembly being actuated to draw said diaphragm into said mechanism space to draw air into said air space through said outlet port and quickly release said diaphragm to force the air out of said air space and out said outlet port, said actuating assembly comprising;

a trigger being slidably coupled to said housing, said trigger being slid from a forward position to a retracted position to actuate said actuating assembly, said trigger being slid into said mechanism space when said trigger is slid from the forward position to the retracted position;

a pivot rod being coupled to said trigger, said pivot rod being moved forward or rearward with said trigger;

a lever being pivotally coupled to said housing, said lever being positioned adjacent to said trigger and said pivot rod, said lever being pivoted by said pivot rod when said pivot rod engages said lever as said pivot rod is moved forward or rearward with said trigger;

a cable being coupled to said lever and said diaphragm, said cable pulling said diaphragm into said mechanism space when said trigger is being slid from the forward position to the retracted position and said pivot rod pivots said lever, said cable being positioned adjacent a rear edge of said lever;

said pivot rod abutting a front edge of said lever adjacent a top edge of said lever when said trigger is in the forward position, said pivot rod forcing said rear edge of said lever to pivot downwardly to pull said cable and thereby draw said diaphragm into said mechanism space, said lever sliding by said pivot rod to release said cable from tension and allow said diaphragm to advance into said air space and force air out of said outlet port when said trigger is in the retracted position, said pivot rod sliding along a portion of said top edge of said lever when said trigger is slid from the retracted position to the forward position;

a plurality of guide pins being coupled to said housing and positioned in said mechanism space, said cable being positioned on said guide pins to retain said cable in a taut condition; and a biasing member being coupled to said actuating assembly to reset said actuating assembly after each actuation, said biasing member being positioned in said mechanism space and extending between said perimeter wall and said trigger, said biasing member biasing said trigger from the retracted position to the forward position when said trigger is released.

* * * * *